US006475686B2

(12) United States Patent
Tamura et al.

(10) Patent No.: US 6,475,686 B2
(45) Date of Patent: Nov. 5, 2002

(54) FIXING METHOD

(75) Inventors: Osamu Tamura, Chiba (JP); Kazunori Kato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/912,539

(22) Filed: Jul. 26, 2001

(65) Prior Publication Data

US 2002/0076638 A1 Jun. 20, 2002

(30) Foreign Application Priority Data

Jul. 28, 2000 (JP) ..... 2000-228115

(51) Int. Cl.[7] ..... G03G 13/20
(52) U.S. Cl. ..... 430/99; 430/124; 430/111.4
(58) Field of Search ..... 430/124, 110.3, 430/110.4, 111.4, 99

(56) References Cited

U.S. PATENT DOCUMENTS

| | | | | |
|---|---|---|---|---|
| 2,297,691 A | | 10/1942 | Carlson | 430/55 |
| 3,578,797 A | | 5/1971 | Hodges et al. | 219/388 |
| 5,014,089 A | | 5/1991 | Sakashita et al. | 355/251 |
| 5,137,796 A | | 8/1992 | Takiguchi et al. | 430/106.6 |
| 5,149,941 A | | 9/1992 | Hirabayashi et al. | 219/216 |
| 5,298,354 A | * | 3/1994 | Matsunaga | 430/99 |
| 5,391,450 A | * | 2/1995 | Nagatsuka et al. | 430/99 |
| 5,721,433 A | | 2/1998 | Kosaka | 250/573 |

FOREIGN PATENT DOCUMENTS

| | | |
|---|---|---|
| JP | 42-23910 | 11/1942 |
| JP | 43-24748 | 10/1943 |
| JP | 63-313182 | 12/1988 |
| JP | 1-112253 | 4/1989 |
| JP | 2-284158 | 11/1990 |
| JP | 8-136439 | 5/1996 |

* cited by examiner

*Primary Examiner*—John Goodrow
(74) *Attorney, Agent, or Firm*—Fitzpatrick, Cella, Harper & Scinto

(57) ABSTRACT

In a fixing method for fixing a toner image to a transfer medium, heat-and-pressure fixing is carried out using a specific pressure member and a specific toner. The pressure member has a heat-resistant elastic layer having a thermal conductivity of 0.20 W/m·K or below. The toner has, in its DSC endothermic curve, at least a maximum value in the region of temperature of from 105° C. to 150° C., and, in GPC of THF-soluble component of the toner, a main peak in the region of molecular weight of from 2,000 to 25,000, a sub-peak or shoulder in the region of molecular weight of 70,000 or higher, and an Mw/Mn ratio of 8 or higher, containing 20% to 70% of a component belonging to the region of molecular weight of from 1,000 to 10,000.

18 Claims, 7 Drawing Sheets

FIXING METHOD

BACKGROUND OF THE INVENTION

1. Field of the Invention

This invention relates to a fixing method for the heat-and-pressure fixing of toner images in electrophotographic techniques.

2. Related Background Art

A number of methods as disclosed in U.S. Pat. No. 2,297,691, Japanese Patent Publication Nos. 42-23910, 43-24748 and so forth are known as methods for electrophotography. In general, copies or prints are obtained by forming an electrostatic latent image on a photosensitive member by various means utilizing a photoconductive material, subsequently developing the latent image by the use of a toner to form a toner image, and transferring the toner image to a transfer medium (recording medium) such as paper if necessary, followed by fixing by the action of heat, pressure, heat-and-pressure, or solvent vapor. The toner that has not transferred to and has remained on the photosensitive member is cleaned by various means, and then the above process is repeated.

In recent years, such copying apparatus have not only been used as copying machines for office working to make copies of originals, but also have begun being used as printers for taking out data values from computers or being used for copying highly minute images such as graphic designs.

As printers, LED printers or LBP printers are prevailing in the recent market. As a trend of techniques, there is a tendency toward higher resolution. More specifically, those which hitherto have a resolution of 240 dpi or 300 dpi are being replaced by those having a resolution of 600 dpi, 800 dpi or 1,200 dpi. Accordingly, with such a trend, the developing systems are now required to achieve a high minuteness. Copying machines have also made progress to have high functions, and hence they trend toward digital systems. In the digital systems, chiefly employed is a method in which electrostatic latent images for toner visible images are formed by using a laser. Hence, the copying machines also trend toward a higher resolution and hence, like the printers, it has been sought to provide a developing system with high resolution and high minuteness. Japanese Patent Application Laid-open Nos. 1-112253 and 2-284158 disclose toners having smaller particle diameters. Accordingly, copying apparatus are severely sought to be more highly reliable. Concurrently therewith, a higher performance has become required, so that any superior machines have become no longer establishable unless the improvement in performances of image-forming apparatus, inclusive of those of toners, can be achieved.

As a means for fixing a visible toner image to a recording medium, a heat-roller fixing system is widely used in which a recording medium holding thereon a visible toner image having not been fixed is heated while it is held and carried between a heat roller maintained at a given temperature and a pressure roller having an elastic layer and coming into pressure contact with the heat roller. A belt fixing system is also known, as disclosed in U.S. Pat. No. 3,578,797.

The heat-roll fixing, however, has the following disadvantages:

(1) A time during which an image-forming operation is prohibited, i.e., what is called a waiting time, is required until the heat roller reaches a preset temperature.

(2) The heat roller must be maintained at an optimum temperature in order to prevent faulty fixing from being caused by the variations of the heat-roller temperature that may occur when the recording medium is passed or because of other external factors, and also to prevent the toner from transferring to the heat roller, i.e., what is called the offset phenomenon. This makes it necessary to make large the heat capacity of the heat roller or heater, and requires a high electric power.

(3) When the recording medium is passed over the heat roller and delivered out, the recording medium and the toner on the recording medium are only slowly cooled because of a high temperature of the heat roller, resulting in a state in which a high adherence of the toner is maintained. Thus, because of the curvature of the roller, there may often occur offset, or paper jam caused by the winding of the recording medium around the roller.

(4) A protective member must be provided so that operators can not directly touch the high-temperature heat roller.

The above problems (1) and (2) in the heat-roll fixing are not fundamentally solved also in the belt fixing system disclosed in U.S. Pat. No. 3,578,797.

Japanese Patent Application Laid-open No. 63-313182 discloses a fixing unit with a short waiting time and a low power consumption, in which a toner visible image is heated via a movable heat-resistant sheet by means of a heating element having a low heat capacity, which generates heat pulsewise by electrification, and is thus fixed to a recording medium.

In a heating-via-film system where an image-fixing sheet is made to pass the surface of a heat roller or film whose surface is formed of a material having releasability to toner while the former's toner image surface is brought into contact with the latter. Since in this method the surface of the heat roller or film comes into contact with the toner image of the image-fixing sheet, a very good thermal efficiency can be achieved when the toner image is fixed onto the image-fixing sheet, so that the fixing can be carried out rapidly. Thus, this method is effective for electrophotographic copying machines.

However, since in the above method the film surface and the toner image come into contact in a molten state of the latter, part of the toner image may adhere and transfer to the film surface and may re-transfer to the next image-fixing sheet to cause the offset phenomenon to contaminate the image-fixing sheet. It is important for the heat fixing system to be so designed that the toner does not adhere to the film surface.

In recent years, from the viewpoint of environmental problems and protection of resources, reclaimed paper is also being increasingly used year by year. Some reclaimed paper, however, contains additives such as calcium carbonate in a large quantity in order to improve the whiteness of paper. Use of such paper causes a problem that any additive and toner having separated from the paper may accumulate on a pressure member of the fixing unit to appear as stained images (hereinafter "pressure roller contamination"). It has been long awaited to prevent the pressure roller contamination conjointly with making fixing units small-size for the achievement of small-size printers, power saving and also making printers high-speed.

SUMMARY OF THE INVENTION

An object of the present invention is to provide a fixing method that can achieve a good fixing performance, promises superior anti-offset properties and also does not cause any pressure roller contamination.

To achieve the above object, the present invention provides a fixing method comprising fixing a toner image to a transfer medium under application of heat and pressure by transporting a transfer medium having a toner image formed of a toner, so as to be held between a heating member and a pressure member; the former having a rotatingly movable heat-resistant film, wherein;

the pressure member comprises a mandrel and provided thereon with a heat-resistant elastic layer having a thermal conductivity of 0.20 W/m·K or below; and the toner comprises toner particles containing at least a binder resin, a colorant and a wax, and an external additive; the toner having, in its DSC endothermic curve, at least a maximum value in the region of temperature of from 105° C. to 150° C., and having, in GPC of THF-soluble component of the toner, a main peak in the region of molecular weight of from 2,000 to 25,000, a sub-peak or shoulder in the region of molecular weight of 70,000 or higher, and an Mw/Mn ratio of 8 or higher, containing 20% to 70% of a component belonging to the region of molecular weight of from 1,000 to 10,000.

DESCRIPTION OF THE PREFERRED EMBODIMENTS

Figure 1:
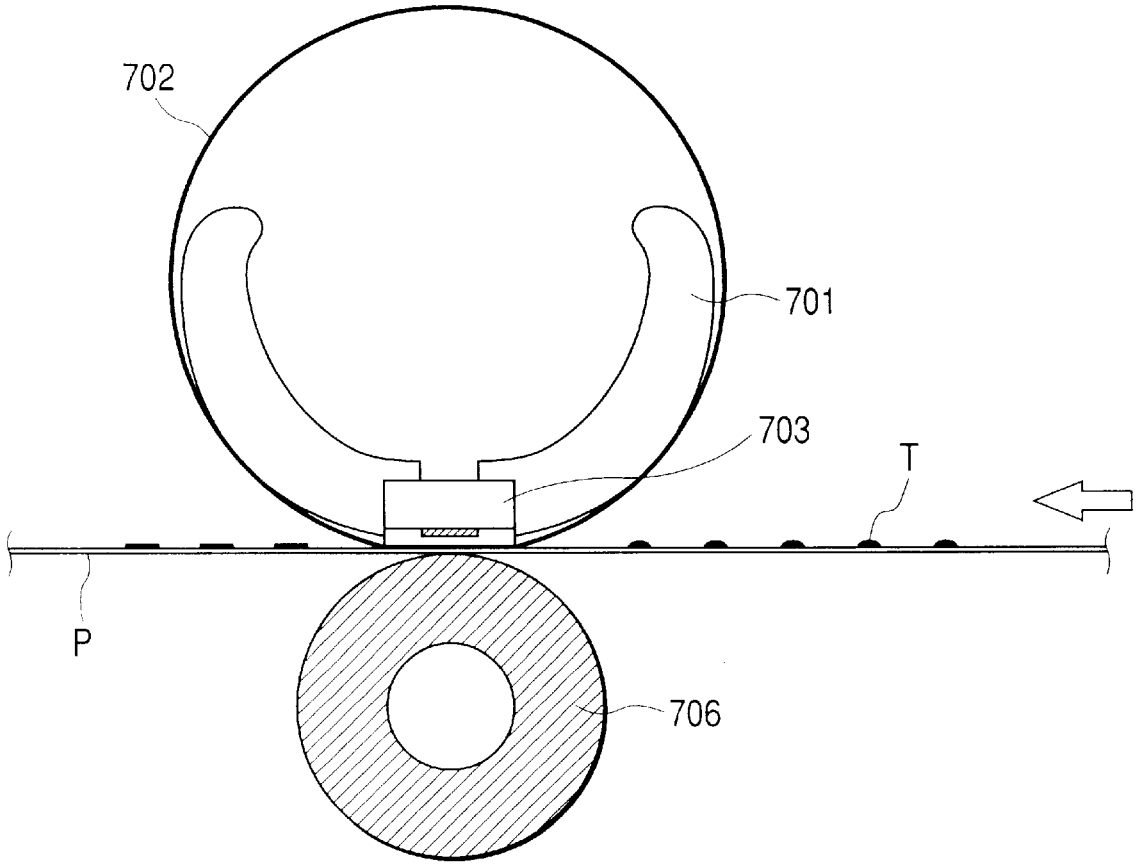
FIG. 1 is a schematic cross-sectional view showing the construction of a heat-and-pressure fixing unit of a tensionless film heating system according to the present invention.

In the present invention, which fulfills the requirements shown in the summary, the fixing can be performed at a small power consumption in a copying machine having a certain process speed, and images can be obtained without causing any offset and also without causing any pressure roller contamination. Fixing and offset correlates closely with molecular weight distribution measured by GPC (gel permeation chromatography) of a toner constituted of a high-molecular-weight resin. A low-molecular-weight component acts effectively on low-temperature fixing performance, and a high-molecular-weight component on high-temperature fixing performance. The pressure roller contamination correlates closely with endothermic temperature in the DSC curve of the toner. The pressure roller contamination can effectively be prevented where the toner has an endothermic peak temperature in the same temperature region as the surface temperature region of the pressure roller.

The toner used in the present invention is described below.

A toner preferably usable in the present invention comprises toner particles containing at least a binder resin, a colorant and a wax, and an external additive. The toner has, in its DSC endothermic curve, at least a maximum value in the region of temperature of from 105° C. to 150° C., and has, in GPC of THF-soluble component of the toner, a main peak P1 in the region of molecular weight of from 2,000 to 25,000, a sub-peak or shoulder P2 in the region of molecular weight of 70,000 or higher, and an Mw/Mn ratio (ratio of weight-average molecular weight Mw to number-average molecular weight Mn) of 8 or higher, containing 20% to 70% of a component belonging to the region of molecular weight of from 1,000 to 10,000.

The DSC endothermic curve and fixing performance and the anti-offset properties and pressure roller contamination correlate closely with each other. In the fixing method of the present invention, the toner having the above thermal properties may preferably be used. A toner having a peak only in the region of temperature lower than 105° C. is not preferable because it may remarkably cause offset and pressure roller contamination. A toner having a peak only in the region of temperature higher than 150° C. is not preferable because it can not achieve low-temperature fixing performance.

The molecular weight distribution measured by GPC of THF-soluble component of the toner and the basic developing performance correlates with each other as a matter of course. In particular, the fixing performance, the anti-offset properties and the pressure roller contamination correlates closely with one another. If the toner has the main peak in the region of molecular weight lower than 2,000, the toner may have a low developing performance to make it difficult to obtain ordinary image density. If it is in the region of molecular weight larger than 25,000, it may be difficult to ensure good fixing performance. If the toner has no sub-peak or shoulder in the region of molecular weight of 70,000 or higher, the toner tends to be less effective for the achievement of good anti-offset properties and the prevention of pressure roller contamination. If the toner has the Mw/Mn ratio lower than 8, it may be difficult to ensure good anti-offset properties. If the component belonging to the region of molecular weight of from 1,000 to 10,000 is less than 20%, it may be difficult to ensure good fixing performance. If it is more than 70%, the toner may cause a lowering of developing performance during running.

The toner used in the present invention is more preferable when it has, in its DSC endothermic curve, a maximum value also in the region of temperature of from 60° C. to 100° C. This enables good achievement of the object of the present invention.

The above DSC endothermic curve correlates greatly with the wax contained in the toner. The molecular weight distribution correlates greatly with the binder resin. The wax used in the present invention is described below.

The wax to be contained in the toner used in the present invention may be any of the following. It may include, e.g., aliphatic hydrocarbon waxes such as low-molecular weight polyethylene, low-molecular weight polypropylene, polyolefin copolymer, polyolefin wax, microcrystalline wax, paraffin wax and Fischer-Tropsh wax; oxides of aliphatic hydrocarbon waxes, such as polyethylene oxide wax; or block copolymers of these; vegetable waxes such as candelilla wax, carnauba wax, japan wax (haze wax) and jojoba wax; animal waxes such as bees wax, lanolin and spermaceti; mineral waxes such as ozokelite, serecin and petrolatum; waxes composed chiefly of a fatty ester, such as montanate wax and caster wax; and those obtained by subjecting part or the whole of a fatty acid to deoxydation, such as deoxidized carnauba was. It may further include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also long-chain alkyl alcohols having a long-chain alkyl group; polyhydric alcohols such as sorbitol; fatty acid amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or acrylic acid to aliphatic hydrocarbon waxes; partially esterified products of polyhydric alcohols with fatty acids, such as monoglyceride behenate; and methyl esterified product having a hydroxyl group, obtained by hydrogenation of vegetable fats and oils.

Waxes preferably used may include polyolefins obtained by radical-polymerizing olefins under high pressure; polyolefins obtained by purifying low-molecular-weight by-products formed at the time of the polymerization of high-molecular-weight polyolefins; polyolefins obtained by polymerization under low pressure in the presence of a catalyst such as a Ziegler catalyst or a metallocene catalyst; polyolefins obtained by polymerization utilizing radiations, electromagnetic waves or light; low-molecular-weight polyolefins obtained by thermal decomposition of high-molecular weight polyolefins; paraffin wax, microcrystalline wax, and Fischer-Tropsh wax; synthetic hydrocarbon waxes obtained by the Synthol method, the Hydrocol process or the Arge process; synthetic waxes produced by using as a monomer a compound having one carbon atom; hydrocarbon waxes having a functional group such as a hydroxyl group or a carboxyl group; mixtures of hydrocarbon waxes and waxes having a functional group; and modified waxes obtained by grafting to any of these waxes serving as a matrix, vinyl monomers such as styrene, maleate, acrylate, methacrylate or maleic anhydride.

The wax may preferably have a melting point of from 105 to 155° C. (maximum endothermic peak), and more preferably from 110 to 150° C. In the present invention, the pressure roller may preferably have a surface temperature of from 110 to 160° C., and more preferably from 110 to 150° C. In order to achieve the object of the present invention at a higher level within this range, the toner may more preferably further contain a wax having a melting point of from 60 to 95° C., having an endothermic main peak in the region of from 60 to 95° C. Accordingly, the toner may preferably have a DSC endothermic peak in the range of from 60 to 90° C. and further have a DSC endothermic peak in the range of from 110 to 150° C.

The wax in the toner used in the present invention may preferably be in a content of from 0.5 to 30 parts by weight, and more preferably from 2 to 10 parts by weight, based on 100 parts by weight of the binder resin.

The melting point of the wax is measured with DSC-7 (differential scanning calorimeter manufactured by Perkin Elmer Co.) at a heating rate of 10° C./min. according to a temperature-measuring pattern prescribed in ASTM D3418, and corresponds to the value of a peak top of the maximum melting temperature thus measured.

The binder resin used in the present invention is described below.

As the binder resin, usable are polystyrene; homopolymers of styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is also a preferred binder resin.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination.

As cross-linking agents, compounds having at least two polymerizable double bonds may be used. Stated specifically, they may include aromatic divinyl compounds such as divinyl benzene and divinyl naphthalene; carboxylates having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The gel permeation chromatography (GPC) of tetrahydrofuran(THF)-soluble component of the toner correlates highly with the GPC of the binder resin. The toner used in the present invention may have, in its molecular weight distribution measured by GPC, at least one peak in the region of molecular weight of from 3,000 to 30,000 as a low-molecular-weight component, and preferably in the region of molecular weight of from 3,000 to 25,000, and at least one peak or shoulder in the region of molecular weight of 100,000 or higher as a high-molecular-weight component. Where the toner has such peaks in its molecular weight distribution, its fixing performance, anti-offset properties and storage stability can be kept in a well balanced state and at the same time the toner can be endowed with durability and uniform chargeability.

If the high-molecular-weight component has a peak molecular weight lower than 100,000, the toner may have a low high-temperature anti-offset properties, and the wax component may have a low dispersibility to come to stand dispersed insufficiently, tending to cause faulty images such as a decrease in image density. Also, if the low-molecular-weight component has a peak molecular weight lower than 3,000, the toner tends to become plastic because of the wax component to tend to cause local phase separation, and hence the toner may be non-uniformly triboelectrically charged to have a low developing performance. If on the other hand the low-molecular-weight component has a peak molecular weight higher than 30,000, the wax component can be dispersed in a state improved to a certain extent and the toner can be improved in developing performance, but may have a low fixing performance.

In order to make the toner have such molecular weight distribution, the binder resin component used in the present invention may preferably be comprised of a low-molecular-weight polymer having at least one peak in the region of molecular weight of from 2,000 to 25,000 and a high-molecular-weight polymer having at least one peak or shoulder in the region of molecular weight of from 100,000 to 1,000,000, in its molecular weight distribution measured by GPC of THF-soluble component.

In such a binder resin component, the wax component may previously be kept mixed and dispersed when the toner is produced. In particular, what is especially preferred is a method in which the wax component and the high-molecular-weight polymer are preliminarily dissolved in a solvent when the binder resin is produced, and thereafter the resultant solution is mixed with a low-molecular-weight polymer solution. Where the wax component and the high-molecular-weight component are previously kept mixed, any phase separation in microscopic regions can be relaxed to make the high-molecular-weight component not undergo re-agglomeration, so that a good state of dispersion with the low-molecular-weight component can be attained.

In the present invention, the molecular weight distribution of the toner or binder resin as measured by GPC using THF as a solvent is measured under the following conditions.

Columns are stabilized in a heat chamber of 40° C. To the columns kept at this temperature, THF as a solvent is flowed at a flow rate of 1 ml per minute, and about 100 $\mu$l of a sample THF solution is injected thereinto to make measurement. In measuring the molecular weight of the sample, the molecular weight distribution ascribed to the sample is calculated from the relationship between the logarithmic value and number of count of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from, e.g., Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way: The sample is put in THF, and is left for several hours, followed by thorough shaking so as to be well mixed with the THF (until coalescent matters of the sample has disappeared), which is further left for at least 12 hours. Here, the sample is so left as to stand in THF for at least 24 hours in total. Thereafter, the solution having been passed through a sample-treating filter (pore size: 0.45 to 0.5 $\mu$m; for example, MAISHORIDISK-H-25-5, available from Toso Co., Ltd. or EKIKURODISK 25CR, available from German Science Japan, Ltd., may be utilized) is used as the sample for GPC. The sample is so adjusted as to have resin components in a concentration of from 0.5 to 5 mg/ml.

In the toner, in order to more stabilize its chargeability, a charge control agent may optionally be used. The charge control agent may preferably be used in an amount of from 0.1 to 10 parts by weight, and more preferably from 1 to 5 parts by weight, based on 100 parts by weight of the binder resin.

The toner used preferably in the present invention may be a magnetic toner containing a magnetic material. The magnetic material used may include metal oxides containing element such as iron, cobalt, nickel, copper, magnesium, manganese, aluminum or silicon. In particular, those composed mainly of iron oxide such as triiron tetraoxide or γ-iron oxide are preferred. From the viewpoint of improving the fluidity of the toner and controlling its chargeability, the magnetic material may also contain silicon atoms. Especially when toner particles have a small diameter, the toner particles themselves have a low fluidity. Hence, no good fluidity can be attained by the addition of an external additive such as inorganic fine powder alone.

The silicon atoms may preferably be contained in an amount of from 0.2 to 2.0 parts by weight based on the weight of the magnetic material. If they are in a content less than 0.2% by weight, the toner may have a low fluidity to tend to make character images have a low sharpness and cause difficulties such as a low solid-black image density. If they are in a content more than 2.0% by weight, the image density tends to decrease especially in a high-temperature high-humidity environment. The silicon atoms may more preferably be in a content of from 0.3 to 1.7% by weight. Particularly preferred is a case in which silicon atoms are present on particle surfaces of the magnetic material in an amount of from 0.05 to 0.5% by weight. In addition to the magnetic material, a pigment or dye such as carbon black or copper phthalocyanine may be used in the toner.

The silicon atoms may be added in the form of a water-soluble silicon compound when the magnetic material is formed. Alternatively, they may be added in the form of a silicate compound after the magnetic material has been formed, filtered and dried, and may be made to fix to the particle surfaces by use of a mix muller or the like.

Particles of the above magnetic material may have a BET specific surface area, as measured by nitrogen gas adsorption, of from 2 to 30 $m^2/g$, and particularly from 3 to 28 $m^2/g$. Also, magnetic particles having a Mohs hardness of from 5 to 7 are preferred.

As the particle shape of the magnetic material, it may be octahedral, hexahedral, spherical, acicular or scaly. Preferred are shapes having less anisotropy, such as octahedral, hexahedral and spherical ones. In order to improve image density, it is particularly preferable for the magnetic material to have a sphericity $\Psi$ of 0.8 or higher. The magnetic particles may preferably have an average particle diameter of from 0.05 to 1.0 μm, more preferably from 0.1 to 0.6 μm, and particularly preferably from 0.1 to 0.4 μm.

The magnetic material may preferably be contained in an amount of from 30 to 200 parts by weight, more preferably from 60 to 200 parts by weight, and still more preferably from 70 to 150 parts by weight, based on 100 parts by weight of the binder resin. If it is in an amount less than 30 parts by weight, the toner may have a low transport performance to tend to make a magnetic toner layer uneven on the developer carrying member to tend to cause uneven images. Also, a decrease in image density tends to occur which is caused by an increase in triboelectricity of the magnetic toner. If on the other hand it is in an amount more than 200 parts by weight, the toner tends to have a low fixing performance.

The charge control agent may include the following.

As charge control agents capable of controlling the toner to be negatively chargeable, organic metal complexes or chelate compounds are effective, which include monoazo metal complexes, metal complexes of aromatic hydroxycarboxylic acids and metal complexes of aromatic dicarboxylic acids. Besides, they include aromatic hydroxycarboxylic acids, aromatic mono- or polycarboxylic acids and metal salts thereof, anhydrides thereof or esters thereof, and phenol derivatives such as bisphenol.

Charge control agents capable of controlling the toner to be positively chargeable include Nigrosine, Nigrosine derivatives, triphenylmethane compounds and organic quaternary ammonium salts.

As a preferred embodiment of the toner used in the present invention, a fluidity improver or an abrasive may further be added.

The fluidity improver may have a number-average particle diameter of from 0.005 to 0.07 μm. It may include, e.g., fine alumina powder and fine silicate powder. These fine powders may preferably be those whose particle surfaces have been subjected to coupling treatment, oil treatment or treatment with a fatty acid. Fine silicate powder subjected to coupling treatment and thereafter further to oil treatment is particularly preferred.

As the abrasive, an abrasive having a number-average particle diameter of from 0.12 to 3.0 μm may preferably be used. It may include, e.g., iron oxide, chromium oxide, calcium titanate, strontium titanate, barium titanate, magnesium titanate, cerium oxide, zirconium oxide, aluminum oxide, titanium oxide, zinc oxide and calcium oxide. Preferably usable are strontium titanate, cerium oxide and titanium oxide.

The fluidity improver may preferably be in a content of from 0.5 to 2.5% by weight based on the weight of the toner. The abrasive may preferably be in a content of from 0.35 to 3.5% by weight based on the weight of the toner.

The toner used in the present invention is more preferable when it has the following circularity.

Toner may have, in its particles of 3 μm or larger diameter, particles with a circularity a of 0.900 or higher as determined from the following equation (A), in a proportion of 90% or larger as number-based cumulative value, and in which;

particles with a circularity a of 0.950 or higher are present in a proportion of 67% or larger as number-based cumulative value;

particles with a circularity a of 0.995 or higher are present in a proportion of 8% or larger as number-based cumulative value; and the particles with a circularity a of 0.995 or higher are present in a proportion which occupies at least 12% of the number-based cumulative value of the particles with a circularity a of 0.950 or higher.

$$\text{Circularity } a = L_0/L \quad \text{(A)}$$

wherein $L_0$ represents the circumferential length of a circle having the same projected area as a particle image, and L represents the circumferential length of the particle image.

Where the toner has the above shape, the pressure roller contamination can more effectively be prevented.

Where the toner is produced by utilizing mechanical impact force, the frictional crushing action causes the wax to melt on its particle surfaces, so that the wax on the particle surfaces covers the magnetic material present at the toner particle surfaces. As the result, since the toner having the above circularity has closely spherical particles compared with toners produced by usual pulverization, the wax is appropriately present on the particle surfaces and also the magnetic material is kept from being laid bare to the surfaces. This is because, if the magnetic material stands bare to the surfaces or any free magnetic material is in a large quantity, the toner tends to adhere to the surface of the pressure roller.

Where the toner having the specific circularity is produced, the toner may preferably be a toner having a weight-average particle diameter of from 5 to 10 μm, containing not more than 40% by number of particles with a particle diameter of 4 μm or smaller, and containing not more than 25% by volume of particles with a particle diameter of 10.1 μm or larger.

Where a toner having a weight-average particle diameter larger than 10 μm is obtained, the load inside a pulverizer is in the direction of being lessened as far as possible, so that the toner particles may be brought into a desired circularity distribution with difficulty, making it difficult to well prevent the pressure roller contamination.

Where a toner having a weight-average particle diameter smaller than 5 μm is obtained, the load inside a pulverizer is in the direction of being enlarged, which is not a direction preferable for the production, and fine powder or ultrafine powder may be formed in a large quantity to tend to cause melt adhesion to drum, fog or faulty cleaning.

If the toner contains more than 25% by volume of the particles with a particle diameter of 10.1 μm or larger, the same difficulties as the case when the toner having a weight-average particle diameter larger than 10 μm is obtained tend to occur.

If the toner contains more than 40% by number of the particles with a particle diameter of 4 μm or smaller, the same difficulties as the case when the toner having a weight-average particle diameter smaller than 5 μm is obtained tend to occur.

The particle size distribution of the toner is measured in the following way.

The particle size distribution can be measured by various means. In the present invention, it is measured with a Coulter counter Multisizer.

A Coulter counter Multisizer Model II or IIE (manufactured by Coulter Electronics, Inc.) is used as a measuring instrument. An interface (manufactured by Nikkaki K.K.) that outputs number distribution and volume distribution and a commonly available personal computer are connected. As an electrolytic solution, an aqueous solution of about 1% NaCl is prepared using the best quality or first-grade sodium chloride. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made with the above Coulter counter Multisizer Model II, using an aperture of 100 $\mu$m. The volume and number of the toner are measured and the volume distribution and number distribution are calculated to determine the weight-based, weight-average particle diameter determined from the volume distribution.

A case in which the particles with a circularity a of 0.900 or higher are present in a proportion smaller than 90% as number-based cumulative value is not preferable because the pressure roller contamination may seriously occur. A case in which the particles with a circularity a of 0.950 or higher are present in a proportion smaller than 67% is also not preferable because the pressure roller contamination may seriously occur. A case in which the particles with a circularity a of 0.955 or higher are present in a proportion smaller than 8% is not preferable because the pressure roller contamination may seriously occur.

In a case in which the particles with a circularity a of 0.995 or higher are present in a proportion less than 12% of the particles with a circularity a of 0.950 or higher, too, the pressure roller contamination tends to occur.

As one standard of the scattering in shape of particles having such circularities, the circularity standard deviation SD may be used. In the present invention, there is no problem as long as the circularity standard deviation SD is in the range of from 0.034 to 0.043.

The average circularity referred to in the present invention is used as a simple method for expressing the shape of toner quantitatively. In the present invention, the shape of particles is measured with a flow type particle image analyzer FPIA-1000, manufactured by Toa Iyou Denshi K.K., and the circularity of particles thus measured is calculated according to the following equation (A). As also further shown in the following equation (B), the value obtained when the sum total of circularity of all particles measured is divided by the number of all particles is defined to be the average circularity.

$$\text{Circularity } a = L_0/L \tag{A}$$

wherein $L_0$ represents the circumferential length of a circle having the same projected area as a particle image, and L represents the circumferential length of the particle image.

$$\text{Average circularity} = \sum_{i=1}^{m} a_i / m \tag{B}$$

The circularity standard deviation SD is calculated from the following equation (C), where the average circularity determined from the above equations (A) and (B) is represented by $\bar{a}$, the circularity in each particle by ai, and the number of particles measured by m.

$$\text{Circularity standard deviation } SD = \sum_{i=1}^{m} (\bar{a} - a_i)^2 / m^{1/2} \tag{C}$$

The circularity referred to in the present invention is an index showing the degree of surface unevenness of toner particles. It is indicated as 1.00 when the toner particles are perfectly spherical. The more complicate the surface shape is, the smaller the value of circularity is. Also, the SD of circularity distribution in the present invention is an index showing the scattering. It indicates that, the smaller the numerical value is, the smaller scattering the shape of toner particles has.

The measuring device "FPIA-1000" used in the present invention employs a calculation method in which, in calculating the circularity of each particle and thereafter calculating the average circularity and circularity standard deviation, circularities of 0.4 to 1.0 are divided into 61 division ranges, and the particles are classified into the division ranges in accordance with the obtained circularities and further the average circularity and circularity standard deviation are calculated using the center values and frequencies of divided points. Between the values of the average circularity and circularity standard deviation calculated by this calculation method and the values of the average circularity and circularity standard deviation calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

As a specific method for the measurement, 0.1 to 0.5 ml of a surface-active agent, preferably alkylbenzene sulfonate, as a dispersant is added to 100 to 150 ml of water from which any impurities have previously been removed. To this solution, about 0.1 to 0.5 g of a measuring sample is further added. The resultant dispersion in which the sample has been dispersed is subjected to dispersion treatment by means of an ultrasonic dispersion machine for about 1 to 3 minutes. Adjusting the dispersion concentration to 3,000 to 10,000 particles/$\mu$l and using the above flow type particle image analyzer, the circularity distribution of particles having circle-corresponding diameters of from 0.60 $\mu$m to less than 159.21 $\mu$m is measured.

The summary of measurement is described in a catalog of FPIA-1000 (an issue of June, 1995), published by Toa Iyou Denshi K.K., and in an operation manual of the measuring apparatus and Japanese Patent Application Laid-open No. 8-136439, and is as follows:

The sample dispersion is passed through channels (extending along the flow direction) of a flat flow cell (thickness: about 200 $\mu$m). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and the circumferential length of the projected image according to the above equation for calculating the circularity.

In a process for producing the toner, a mixture containing at least the binder resin, the magnetic material and the wax is melt kneaded to obtain a kneaded product. After the kneaded product is cooled, the cooled product is crushed by a crushing means to obtain a crushed product, which is used as a powder material. Then, the powder material is first introduced in a stated quantity into a mechanical grinding machine having at least a rotor which is a rotator attached to the center rotating shaft and a stator which is provided around the rotor, keeping a certain space between it and the rotor surface; the grinding machine being so constructed that a circular space formed by keeping that space stands airtight. The rotor of the mechanical grinding machine is rotated at a high speed to finely pulverize the powder material (product to be pulverized). Next, the finely pulverized powder material is introduced to a classification step and is classified there to obtain a classified product serving as a toner base material, comprised of a group of particles having the prescribed particle size. Here, in the classification step, a multi-division gas current classifier having at least a coarse-powder region, a median-powder region and a fine-powder region may preferably be used as a classifying means. For example, when a triple-division gas current classifier is used, the powder material is classified at least into three fractions of fine powder, median powder and coarse powder. In the classification step making use of such a classifier, the coarse powder consisting of a group of particles having particle diameters larger than the desired particle size and fine powder consisting of a group of particles having particle diameters smaller than the desired particle size are removed, and the median powder is used as a toner product as it is, or is blended with an external additive such as hydrophobic colloidal silica and thereafter used as a toner.

The fine powder consisting of a group of particles having particle diameters smaller than the desired particle size is usually reused by feeding it to the step of melt kneading for producing the powder material comprised of toner materials which is to be introduced to the step of pulverization, or discarded. Also, ultrafine powder slightly produced in the pulverization step and classification step, having much smaller particle diameters than the fine powder, is likewise reused by feeding it to the melt kneading step, or discarded.

The mechanical grinding machine used preferably as a pulverization means used in the toner production process in the present invention is described below. The mechanical grinding machine may include, e.g., grinding machines KTM and kryptron, manufactured by Kawasaki Heavy Industries, Ltd.; and Turbo mill, manufactured by Turbo Kogyo K.K. These machines may be used as they are, or may preferably be used after they are appropriately remodeled.

To produce the toner used in the present invention, a mixture containing at least the binder resin, the magnetic material and the wax is used as a material. Besides, a charge control agent and other additives may optionally be used. These materials are thoroughly mixed by means of a mixing machine such as a Henschel mixer or a ball mill, and then the mixture obtained is melt-kneaded by means of a heat kneading machine such as a heat roll, a kneader or an extruder to make the resin and so forth melt one another, in which a pigment or dye is dispersed or dissolved, followed by cooling for solidification and thereafter pulverization and classification. Thus, the toner can be obtained. In the present invention, a unit system constructed as described later is used in the pulverization step and the classification step.

As the mixing machine, it may include Henschel Mixer (manufactured by Mitsui Mining & Smelting Co., Ltd.); Super Mixer (manufactured by Kawata K.K.); Conical Ribbon Mixer (manufactured by Ohkawara Seisakusho K.K.); Nauta Mixer, Turbulizer and Cyclomix (manufactured by Hosokawa Mikuron K.K.); Spiral Pin Mixer (manufactured by Taiheiyo Kiko K.K.); and Lodige Mixer (manufactured by Matsubo K.K.). As the kneading machine, it may include KRC Kneader (manufactured by Kurimoto Tekkosho K.K.); Buss-Kneader (manufactured by Buss Co.); TEM-type Kneader (manufactured by Toshiba Machine Co., Ltd.); TEX Twin-Screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-type Pressure Kneader, Kneader-Ruder (manufactured by Moriyama Seisakusho K.K.); and Banbury Mixer (manufactured by Kobe Seikosho K.K.). Also, as a sifter used to sieve coarse powder and so forth, it may include Ultrasonics (manufactured by Koei Sangyo K.K.); Rezona Sieve, Gyro Sifter (manufactured by Tokuju Kosakusho K.K.); Vibrasonic Sifter (manufactured by Dulton Co.); Sonicreen (manufactured by Shinto Kogyo K.K.); Turbo-Screener (manufactured by Turbo Kogyo K.K.); Microsifter (manufactured by Makino Sangyo K.K.); and circular vibrating screens.

A preferred production flow for the toner used in the present invention is specifically described below with reference to FIGS. 3 to 8.

Figure 3:
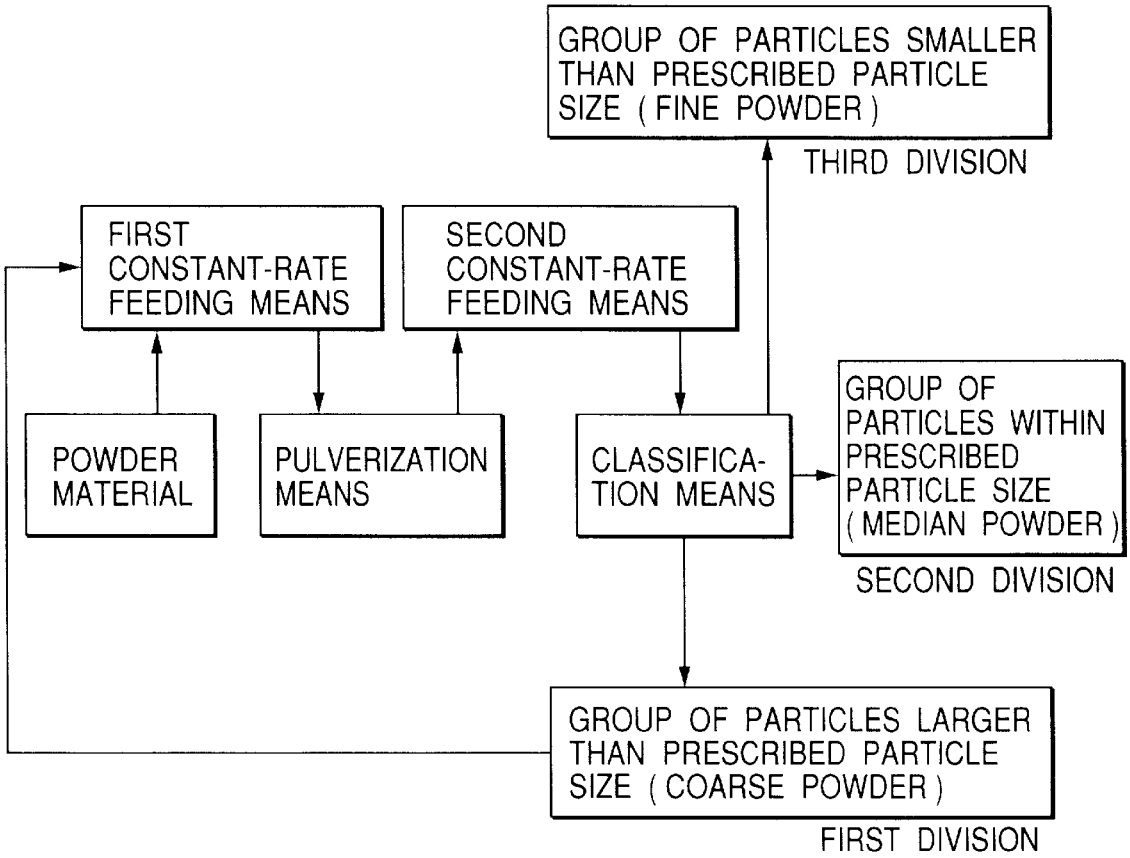
FIG. 3 is a flow chart for describing a toner production process.

FIG. 3 is an example of a flow chart showing an outline of the toner production process. As shown in the flow chart, the toner production process does not require any classification step before pulverization treatment, and the pulverization step and the classification step may preferably be carried out in one pass.

In the toner production process, the number of free magnetic iron oxide particles and the circularity of the toner can be controlled by producing the toner by using specific toner constituent materials and selecting production conditions variously. In general, as a powder material, the crushed product is used which is obtained by melt-kneading a mixture containing at least the binder resin, the magnetic material and the wax, cooling the kneaded product thus obtained, and thereafter crushing the cooled product by a crushing means. Then, as described previously, the powder material is first introduced in a stated quantity into the mechanical grinding machine having at least a rotor comprising a rotator attached to the center rotating shaft and a stator which is provided around the rotor, keeping a certain space between it and the rotor surface; the grinding machine being so constructed that a circular space formed by keeping the space stands airtight. The rotor of the mechanical grinding machine is rotated at a high speed to finely pulverize the powder material (product to be pulverized). Next, the finely pulverized powder material is introduced to the classification step and is classified there to obtain a classified product serving as a toner base material, comprised of a group of particles having the prescribed particle size. Here, in the classification step, the multi-division gas current classifier having at least a coarse-powder region, a median-powder region and a fine-powder region may preferably be used as a classifying means. For example, when a triple-division gas current classifier is used, the powder material is classified at least into three fractions of fine powder, median powder and coarse powder. In the classification step making use of such a classifier, the coarse powder consisting of a group of particles having particle diameters larger than the desired particle size and fine powder consisting of a group of particles having particle diameters smaller than the desired particle size are removed, and the median powder is used as a toner product as it is, or is blended with an external additive such as hydrophobic colloidal silica and thereafter used as a toner.

Ultrafine powder consisting of a group of particles having particle diameters smaller than the desired particle size is usually reused by feeding it to the step of melt kneading for producing the powder material comprised of toner materials which is to be introduced to the step of pulverization, or discarded.

Figure 4:
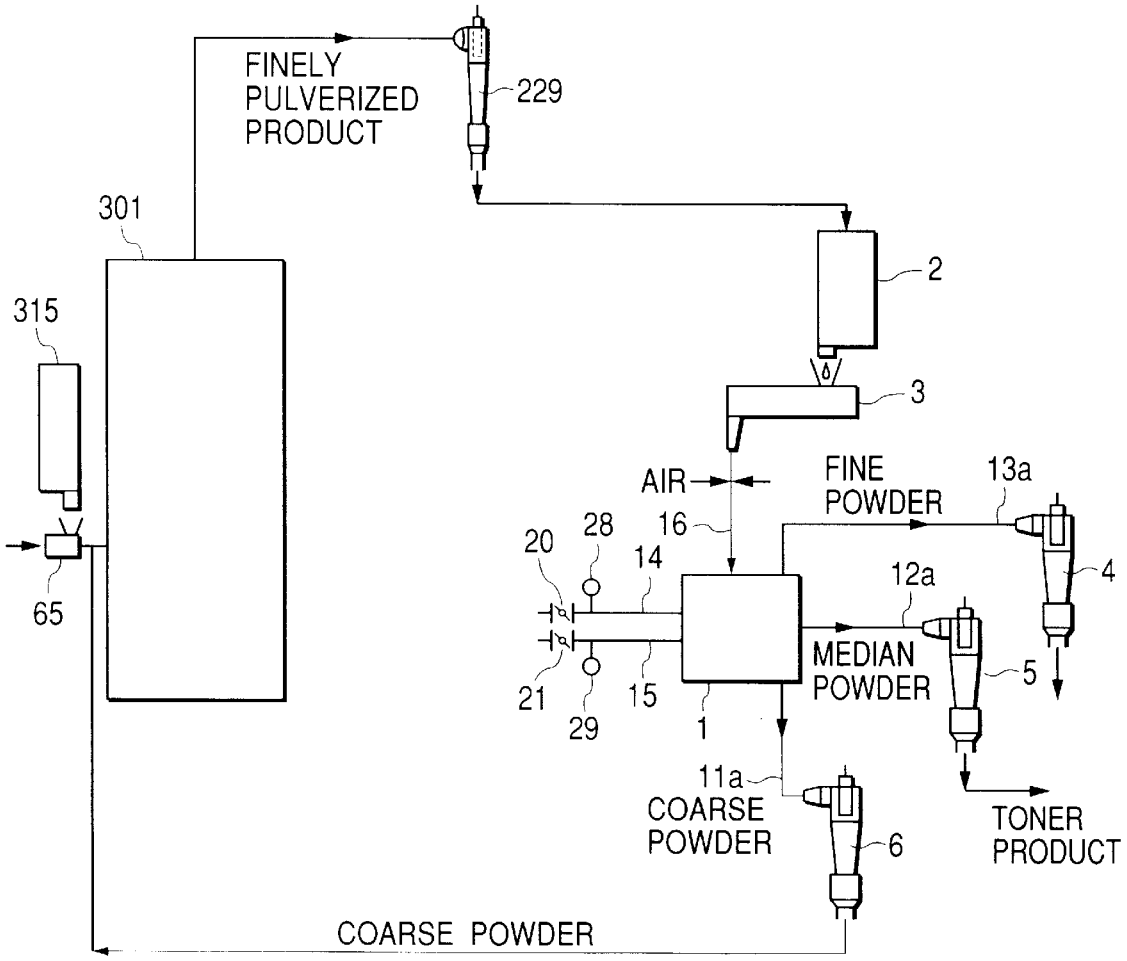
FIG. 4 is a schematic view of an example of a unit system for carrying out the toner production process.

FIG. 4 shows an example of a unit system to which the above toner production process has been applied. The process is further specifically described below with reference to this drawing. As the toner base material powder material introduced into this unit system, colored resin particle powder containing at least the binder resin, the colorant and the wax is used. As the powder material, a material is used which is obtained by, e.g., melt-kneading a mixture comprised of the binder resin, the magnetic iron oxide and the wax, cooling the kneaded product obtained and further crushing the cooled product by a crushing means.

In this unit system, the toner base material powder material is introduced in a stated quantity into a mechanical grinding machine 301 which is the pulverization means, via a first constant-rate feeder 315. The powder material introduced into it is instantaneously pulverized by means of the mechanical grinding machine 301, and then introduced into a second constant-rate feeder 2 via a collecting cyclone 229. Then, via vibrating feeder 3 and further via a material feed nozzle 16, it is fed into a multi-division gas current classifier 1 which is the classification means.

The gas current classifier is usually used as a component unit of a unit system in which correlated equipments are connected through communicating means such as pipes. FIG. 4 shows a preferred example of such a unit system. In the unit system shown in FIG. 4, a triple-division classifier 1 (the classifier shown in FIG. 8), a constant-rate feeder 2, a vibrating feeder 3, a collecting cyclone 4, a collecting cyclone 5 and a collecting cyclone 6 are connected through communicating means.

In this unit system, the material powder is fed into the constant-rate feeder 2 through a suitable means, and then introduced into the triple-division classifier 1 from the vibrating feeder 3 through the material feed nozzle 16. When introduced, the material powder may preferably be fed into the triple-division classifier 1 at a flow velocity of 10 to 350 m/second. The classifying chamber of the triple-division classifier 1 is constructed usually with a size of (10 to 50 cm)×(10 to 50 cm), so that the material powder can instantaneously be classified in 0.1 to 0.01 second or less, into three or more groups of particles. Then, the material powder is classified by the triple-division classifier 1 into the group of larger particles (coarse particles), group of median particles and group of smaller particles. Thereafter, the group of larger particles is passed through a discharge guide pipe 11*a*, and sent to and collected in the collecting cyclone 6 and then returned to the mechanical grinding machine 301. The group of median particles is discharged outside the classifier through the discharge pipe 12*a*, and collected in the collecting cyclone 5 so as to be used as the toner. The group of smaller particles is discharged outside the classifier through the discharge pipe 13*a* and collected in the collecting cyclone 4, where it is reused by feeding it to the step of melt kneading for producing the powder material comprised of toner materials, or discarded. The collecting cyclones 4, 5 and 6 may also function as suction evacuation means for suction feeding the material powder to the classifying chamber through the material feed nozzle 16. Also, the group of larger particles classified here may preferably be again introduced into the first constant-rate feeder 315 so as to be mixed in the powder material and again pulverized by the mechanical grinding machine 301.

In the above unit system to which the toner production process has been applied, the process does not require any first classification step before pulverization treatment, and the pulverization step and the classification step can be carried out in one pass.

As described previously, the mechanical grinding machine which may preferably used for the production of the toner may include, e.g., grinding machines KTM, manufactured by Kawasaki Heavy Industries, Ltd.; and Turbo mill, manufactured by Turbo Kogyo K.K. These machines may be used as they are, or may preferably be used after they are appropriately remodeled.

Figure 5:
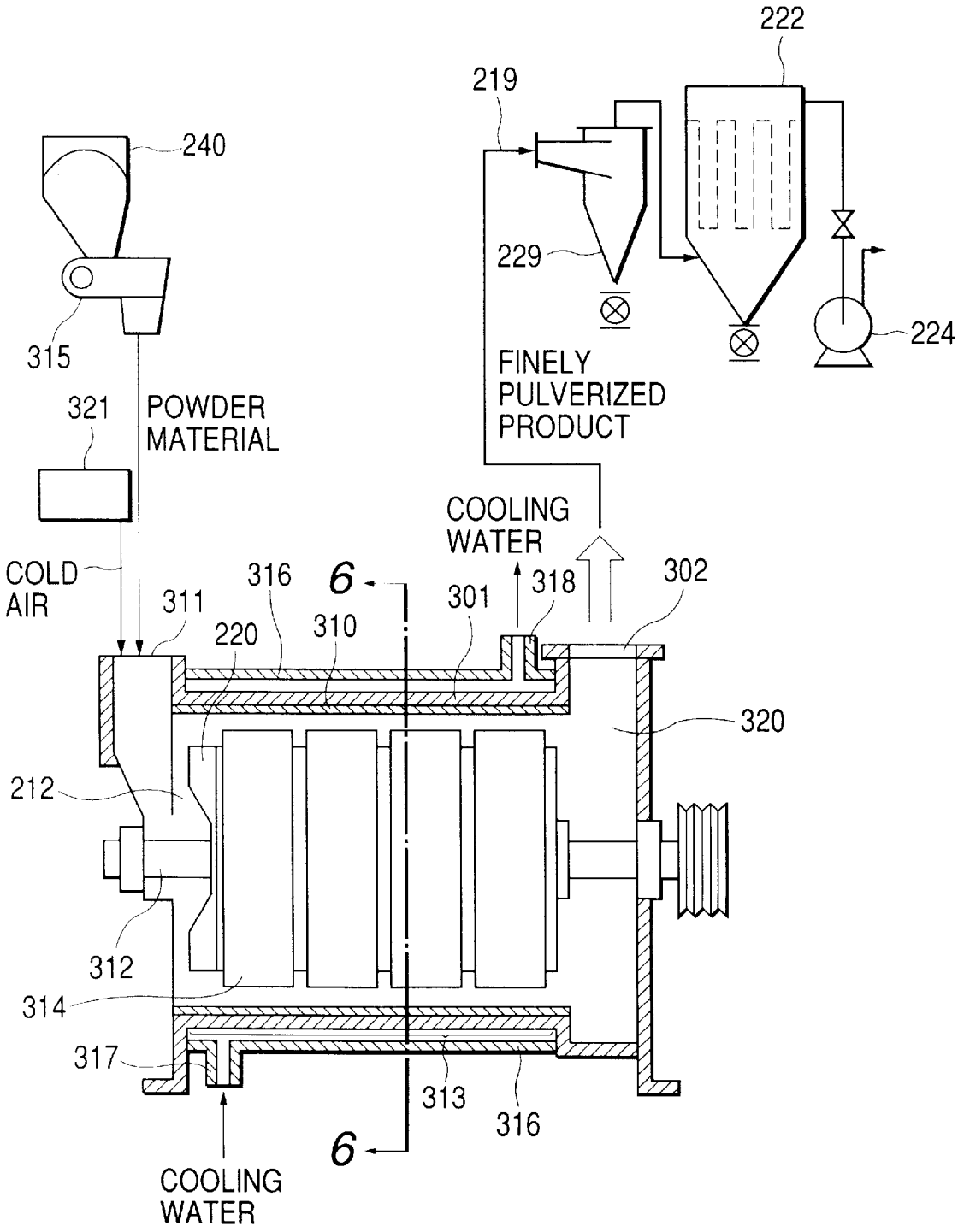
FIG. 5 is a schematic cross-sectional view of a mechanical grinding machine used in the step of pulverizing a toner material.
Figure 6:
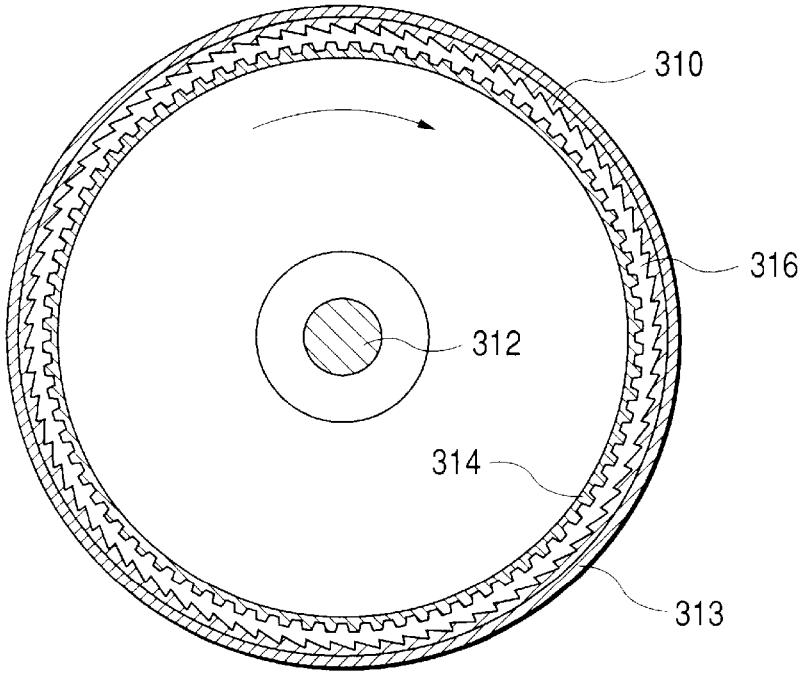
FIG. 6 is a schematic cross-sectional view along the line 6—6 in FIG. 5.
Figure 7:
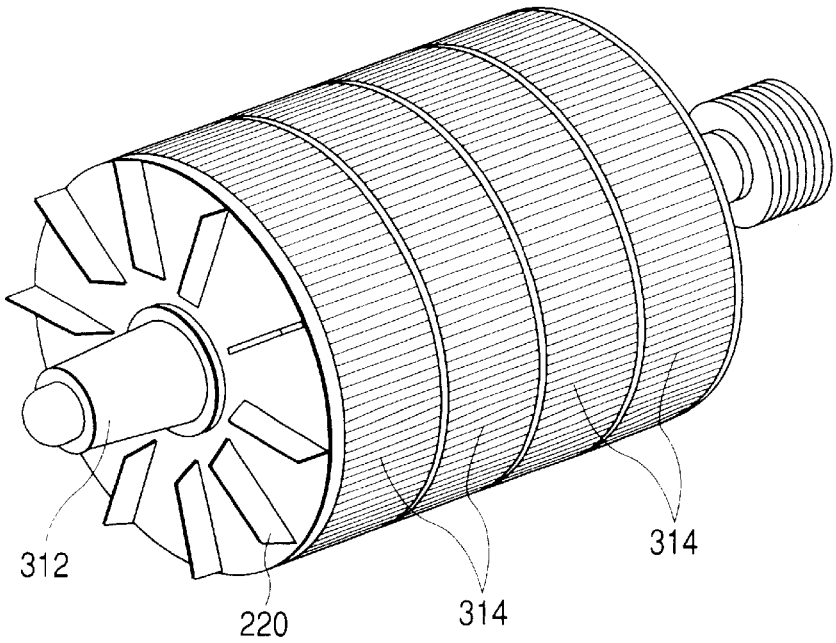
FIG. 7 is a perspective view of a rotor shown in FIG. 5.

In particular, a mechanical grinding machine as shown in FIGS. 5 to 7 may be used and the toner may be produced using specific materials as toner constituent materials. This is preferable as a process by which the toner can be produced controlling the shape of toner particles and the number of free magnetic iron oxide particles. This process also enables easy pulverization treatment of the powder material, and hence the improvement in efficiency can be achieved advantageously.

In collision air pulverization conventionally carried out, toner particles are caused to collide against the colliding surface of an colliding member so that the particles are pulverized by the impact produced by it, and hence free magnetic iron oxide particles tend to occur at the time of collision. Also, the toner particles thus formed by pulverization may be amorphous and have a squared shape, and hence magnetic iron oxide particles tend to come off from toner particles. Also, the toner produced by the collision air pulverization may be subjected to mechanical impact (hybridizer) to modify the shape and surface properties of particles. However, since in the collision pulverization the toner particles are caused to collide against the colliding surface of an colliding member so that the particles are pulverized by the impact produced by it, free magnetic iron oxide particles tend to occur at the time of collision. When the shape of particles is modified by mechanical impact to make it closely spherical, though the magnetic iron oxide particles can be made to come off from toner particles with difficulty compared with amorphous toner particles, it is difficult to control the shape of toner particles and the number of free magnetic iron oxide particles, compared with the toner production process making use of the mechanical grinding machine.

The mechanical grinding machine shown in FIGS. 5 to 7 is described below. FIG. 5 is a schematic cross-sectional view of an example of the mechanical grinding machine. FIG. 6 is a schematic cross-sectional view along the line 6—6 in FIG. 5. FIG. 7 is a perspective view of a rotor 314 shown in FIG. 5. This apparatus is constituted of, as shown in FIG. 5, a casing 313, a jacket 316, a distributor 220, a rotor 314 which is provided in the casing 3, constituted of a rotator attached to a center rotating shaft 312, rotatable at a high speed and provided with a large number of grooves on its surface, a stator 310 which is disposed keeping a certain space along the periphery of the rotor 314 and provided with a large number of grooves on its surface, a material feed opening 311 for introducing therethrough the material to be treated, and also a material discharge opening 302 for discharging therethrough the powder having been treated.

The pulverization using the mechanical grinding machine constituted as described above is operated, e.g. in the following way. The powder material is put in a stated quantity into the mechanical grinding machine from its material feed opening 311 as shown in FIG. 5, where the powder material is introduced into a pulverizing chamber front zone 212, and is instantaneously pulverized by the action of i) the impact produced between the rotor 314 rotating at a high speed in the pulverizing chamber and provided with a large number of grooves on its surface and the stator 310 provided with a large number of grooves on its surface, ii) a large number of ultrahigh-speed whirls produced on the back of this impact and iii) the pressure vibration with high frequency that is caused by such whirls. Thereafter, the powder material is discharged passing through the material discharge opening 302. The air which is transporting the material particles is discharged outside the unit system via a pulverizing chamber rear zone 320 and through a pipe 219, a collecting cyclone 229 a bag filter 222 and a suction filter 224. In this production process, the powder material is pulverized and hence the desired pulverization can be performed with ease without increasing the fine powder and coarse powder.

When the powder material is pulverized by means of the mechanical grinding machine, cold air may be sent into the mechanical grinding machine by a cold air generating means 321 together with the powder material, and also the main body of the mechanical grinding machine may be so constructed as to have the jacket 316 structure and cold water (or preferably an anti-freeze such as ethylene glycol) may be passed therethrough, whereby the environmental temperature inside the grinding machine may be controlled to 0° C. or below, preferably from −5 to −15° C., and more preferably from −7 to −12° C. This is preferable in view of the productivity of toner.

The cold water (or preferably an anti-freeze such as ethylene glycol) is fed into the jacket from a cold water feed opening 317 and is discharged through a cold water discharge opening 318.

When the powder material is pulverized by means of the mechanical grinding machine, the chamber temperature T1 at the pulverizing chamber front zone (whirl chamber) 212 and the chamber temperature T2 at the pulverizing chamber rear zone 320 may preferably be so controlled as to be in a temperature difference ΔT (T2−T1) of from 30 to 80° C., more preferably from 35 to 75° C., and still more preferably from 37 to 72° C. This can prevent toner particles from undergoing surface deterioration due to heat, in particular, from liberation of the magnetic iron oxide present on the toner particle surfaces, and enables pulverization of the powder material in a good efficiency.

The rotor 314 may preferably be rotated at a peripheral speed of from 80 to 180 m/s, more preferably from 90 to 170 m/s, and still more preferably from 100 to 160 m/s. This is preferable in view of the productivity of toner. Where the rotor 314 is preferably rotated at a peripheral speed of from 80 to 180 m/s, more preferably from 90 to 170 m/s, and still more preferably from 100 to 160 m/s, the powder material can be kept from being insufficiently pulverized or excessively pulverized or the magnetic iron oxide from its liberation due to any excessive pulverization, and the powder material can be pulverized in a good efficiency.

The space between the rotor 314 and the stator 310 may preferably be set at a minimum gap of from 0.5 to 10.0 mm, more preferably from 1.0 to 5.0 mm, and still more preferably from 1.0 to 3.0 mm. Where the space between the rotor 314 and the stator 310 is preferably set at a gap of from 0.5 to 10.0 mm, more preferably from 1.0 to 5.0 mm, and still more preferably from 1.0 to 3.0 mm, the powder material can be kept from being insufficiently pulverized or excessively pulverized or the magnetic iron oxide from its liberation due to any excessive pulverization, and the powder material can be pulverized in a good efficiency.

In the mechanical grinding machine used in this production process, the pulverizing surfaces of the rotor and stator may be controlled to have a suitable surface roughness so that any free magnetic iron oxide particles can be kept from being produced and a toner having good developing performance, transfer performance and charging performance can be obtained. More specifically, the pulverizing surfaces of the rotor 314 and stator 310 may be made to have a center-line average surface roughness Ra of 10.0 μm or smaller, and more preferably from 2.0 to 10.0 μm, a maximum roughness Ry of 60.0 μm or smaller, and more preferably from 25.0 to 60.0 μm, and a ten-point average roughness Rz of 40.0 μm or smaller, and more preferably from 20.0 to 40.0 μm.

The gas current classifier used preferably as a classification means constituting the toner production process is described below.

Figure 8:
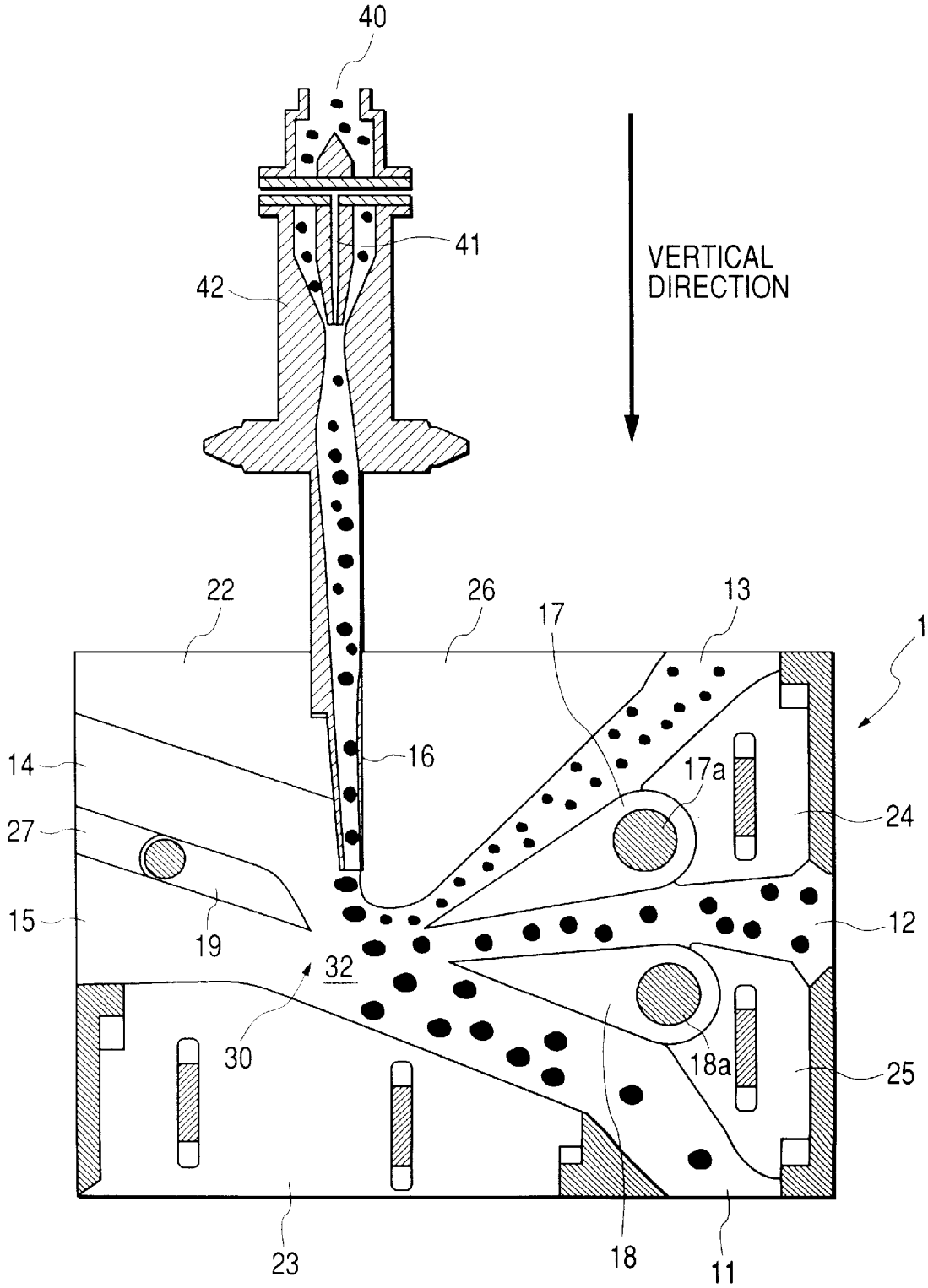
FIG. 8 is a schematic cross-sectional view of a multidivision air classifier used in the step of classifying toner particles

As an example of a preferred multi-division gas current classifier, an apparatus constructed as shown in FIG. 8 (cross-sectional view) is shown as a specific example.

As shown in FIG. 8, a sidewall 22 and a G-block 23 form part of a classifying chamber, and classifying edge blocks 24 and 25 have classifying edges 17 and 18, respectively. The G-block 23 is right and left slidable for its setting position. Also, the classifying edges 17 and 18 stand swing-movable around shafts 17*a* and 18*a*, respectively, and thus the tip position of each classifying edge can be changed by the swinging of the classifying edge. The respective classifying edge blocks 24 and 25 are so set up that their locations can be slided right and left. As they are slided, the corresponding knife-edge type classifying edges 17 and 18 are also slided right and left. These classifying edges 17 and 18 divide a classification zone 30 of the classifying chamber 32 into three sections.

A material feed nozzle 16 having at its rearmost-end part a material feed opening 40 for introducing a material powder therethrough, having at its rear-end part a high-pressure air nozzle 41 and a material powder guide nozzle 42 and also having an orifice in the classifying chamber 32 is provided on the right side of the sidewall 22, and a Coanda block 26 is disposed along an extension of the lower tangential line of the material feed nozzle 16 so as to form a long elliptic arc. The classifying chamber 32 has a left-part block 27 provided with a knife edge-shaped air-intake edge 19 extending toward the classifying chamber 32, and further provided with air-intake pipes 14 and 15 on the left side of the classifying chamber 32. Also, as shown in FIG. 4, the air-intake pipes 14 and 15 are provided with a first gas feed control means 20 and a second gas feed control means 21, respectively, comprising, e.g. a damper, and also provided with static pressure gauges 28 and 29, respectively.

The locations of the classifying edges 17 and 18, the G-block 23 and the air-intake edge 19 are adjusted according to the kind of the toner particles, the material powder to be classified, and also according to the desired particle size.

At the bottom, sidewall and top of the classifying chamber 32, discharge outlets 11, 12 and 13, respectively, which open to the classifying chamber are provided correspondingly to the respective divided zones. The discharge outlets 11, 12 and 13 are connected with communicating means such as pipes, and may respectively be provided with shutter means such as valve means.

The material feed nozzle 16 comprises a rectangular pipe section and a pyramidal pipe section, and the ratio of the inner diameter of the rectangular pipe section to the inner diameter of the narrowest part of the pyramidal pipe section may be set at from 20:1 to 1:1, and preferably from 10:1 to 2:1, to obtain a good feed velocity.

The classification in the multi-division classifying zone having the above construction is operated, for example, in the following way. The inside of the classifying chamber is evacuated through at least one of the discharge outlets 11, 12 and 13. The material powder is jetted, and dispersed, into the classifying chamber 32 through the material feed nozzle 16 at a flow velocity of preferably from 10 m/sec to 350 m/s, utilizing the gas stream flowing at a reduced pressure through the path inside the material feed nozzle 16 opening into the classifying chamber 32 and utilizing the ejector effect of compressed air jetted from the high-pressure air nozzle 41.

The particles in the material powder fed into the classifying chamber is moved to draw curves by the action attributable to the Coanda effect of the Coanda block 26 and the action of gases such as air concurrently flowed in, and are classified according to the particle size and inertia force of the individual particles in such a way that larger particles (coarse particles) are classified to the outside of gas streams, i.e., the first division on the outer side of the classifying edge 18, median particles are classified to the second division defined between the classifying edges 18 and 17, and smaller particles are classified to the third division at the inner side of the classifying edge 17. The larger particles separated by classification, the median particles separated by classification and the smaller particles separated by classification are discharged from the discharge outlets 11, 12 and 13, respectively.

In the above classification of material powder, the classification points chiefly depend on the tip positions of the classifying edges 17 and 18 with respect to the lower end of the Coanda block 26 at which end the material powder is jetted out into the classifying chamber 32. The classification points are also affected by the suction flow rate of classification gas streams or the velocity of the material powder jetted out of the material feed nozzle 16.

In the above production process and production system, the toner having a weight-average particle diameter of from 5 to 10 $\mu$m and a sharp particle size distribution can be produced in a good efficiency by controlling conditions for the pulverization and classification.

A heat-and-pressure fixing unit used in the present invention is described below.

The heat-and-pressure fixing unit used in the present invention is a heat-and-pressure fixing unit in which a member to be heated is held and carried between a heat-resistant film and a pressure member so disposed as to come into pressure contact with a heating element via the heat-resistant film, to impart heat energy to the member to be heated. The pressure member (pressure roller) comprises a mandrel having thereon a heat-resistant elastic layer with a thermal conductivity of 0.20 W/m·k or lower, and preferably from 0.05 to 0.20 W/m·k. More preferably used is a fixing unit having a fixing speed of 55 mm/second or higher, preferably from 55 to 250 mm/second, and having a power consumption of from 0.40 to 0.70 Wh/sheet at the heating member.

The pressure roller has a lower thermal conductivity than conventional pressure rollers, and hence the roller can more easily retain heat at its surface than conventional pressure rollers. This acts very effectively on low-temperature fixing performance. Moreover, any toner having adhered to the roller surface can readily soften again, and hence can move to the paper little by little. This prevents the toner from accumulating in excess on the pressure roller. In this connection, pressure rollers usually have a surface temperature of from 100° C. to 150° C. at the time of image formation, which is substantially in agreement with the DSC endothermic peak temperature of the toner used in the present invention. The use of the pressure roller according to the present invention makes it possible to achieve a good fixing performance and lessen the pressure roller contamination even when the fixing speed is 55 mm/second or higher, and also makes it possible to control the power consumption to 0.40 to 0.70 Wh/sheet at the heating member. On the other hand, there is also a problem that, after copies have continuously been taken on small-size sheets of paper, the temperature may severely rise at the part where the small-size sheets have not passed, to tend to cause offset at that part when copies are taken on larger-size sheets such as A4-size sheets immediately after that.

The power consumption is measured in the following way: In an environment of 23° C. and 60%RH, electric power consumed after the heater temperature reaches 200° C. and a recording medium thrusts into the fixing nip and until it passes therethrough is measured to determine power consumption per sheet of image-recorded paper.

FIG. 1 schematically cross-sectionally illustrates the construction of a heat-and-pressure fixing unit of a tensionless film heating system as an example for working the present invention.

Reference numeral 701 denotes an oblong stay made of resin, and serves as an inner-surface guide member of a film described later. Reference numeral 702 denotes an endless heat-resistant film, and is brought into external contact with the stay 701, holding therein a heater 703. With regard to the inner peripheral length of this endless heat-resistant film 702 and the outer peripheral length of the stay 701 holding therein the heater 703, the former, that of the film 702, is set larger by about 3 mm than the latter. Hence, with allowance in peripheral length, the film 702 can loosely be brought into external contact with the stay 701 holding therein the heater 703.

To make the film 702 have a small heat capacity to improve quick-start performance, the film 702 may have a layer thickness of about 100 $\mu$m or smaller and may be formed of a single layer of PTFE, PFA or FEP, having heat resistance, releasability, strength and durability. Also usable is a laminated film having a layer of polyimide, polyamide, PEEK, PES or PPS the outer peripheral surface of which has been coated with PTFE, PFA or FEP.

In an embodiment of the present invention, a 50 $\mu$m thick polyimide film the outer peripheral surface of which has been coated with PTFE in a thickness of 10 $\mu$m to have a total layer thickness of 60 $\mu$m is used as the heat-resistant film 702.

Reference numeral 703 denotes the heater, which comprises a substrate formed of alumina along substantially the central portion of which an electrical resistant material such as Ag/Pd (silver/palladium) as a heating element has been coated by screen printing in a thickness of about 10 $\mu$m and a width of from 1 to 3 mm, and further coated thereon with glass or fluorine resin as a protective layer. This heater is provided with a thermistor for the heater on its side opposite to the film 702 (fixing film), and the temperature of the heater 703 is controlled according to the temperature detected by the thermistor.

A pressure roller 706 is a rotator which holds the film 702 between itself and the heater 703 to form a fixing nip to drive the film, and is connected to a drive unit through its mandrel formed of iron, stainless steel or aluminum. The pressure roller 706 is so set up as to be rotated by the transmission of a drive force from a drive motor of the drive unit.

A recording medium P as the material to be heated is transported and passed through the fixing nip formed interposing the film 702 between the pressure roller 706 and the heater 703, so that toner images T are fixed onto the transfer medium (recording medium) P by heat-and-pressure fixing.

The pressure roller 706 according to the present embodiment comprises a mandrel having an outer diameter of 13 mm and made of aluminum, connected to the drive unit, and covered thereon with a silicone foam as the heat-resistant elastic layer, having a length of 240 mm, a thickness of 3 mm and a thermal conductivity of 0.1 W/m·k. The thermal conductivity is measured with a quick thermal conductivity meter QMT-500, manufactured by Kyoto Denshi Kogyo K.K. It is measured using an actual pressure roller as an object of measurement.

The heat-resistant elastic layer may preferably have a thermal conductivity of 0.1 W/m·k or less. The use of the pressure roller constructed as in the present embodiment does not make any heating rise time long which otherwise may become long because of a loss of heat by the pressure roller itself. Also, any excessive power consumption which may be made concurrently therewith can be avoided, and still also an improvement can be achieved in the fixing performance required immediately after a power source has been put on.

As materials used to form the heat-resistant elastic layer with which the pressure roller is covered, preferably used are fluorine rubbers, silicone rubbers, silicone rubber foams, melamine foams and silicone foams. Silicone rubber foams, melamine foams and silicone foams are more preferred.

Figure 2:
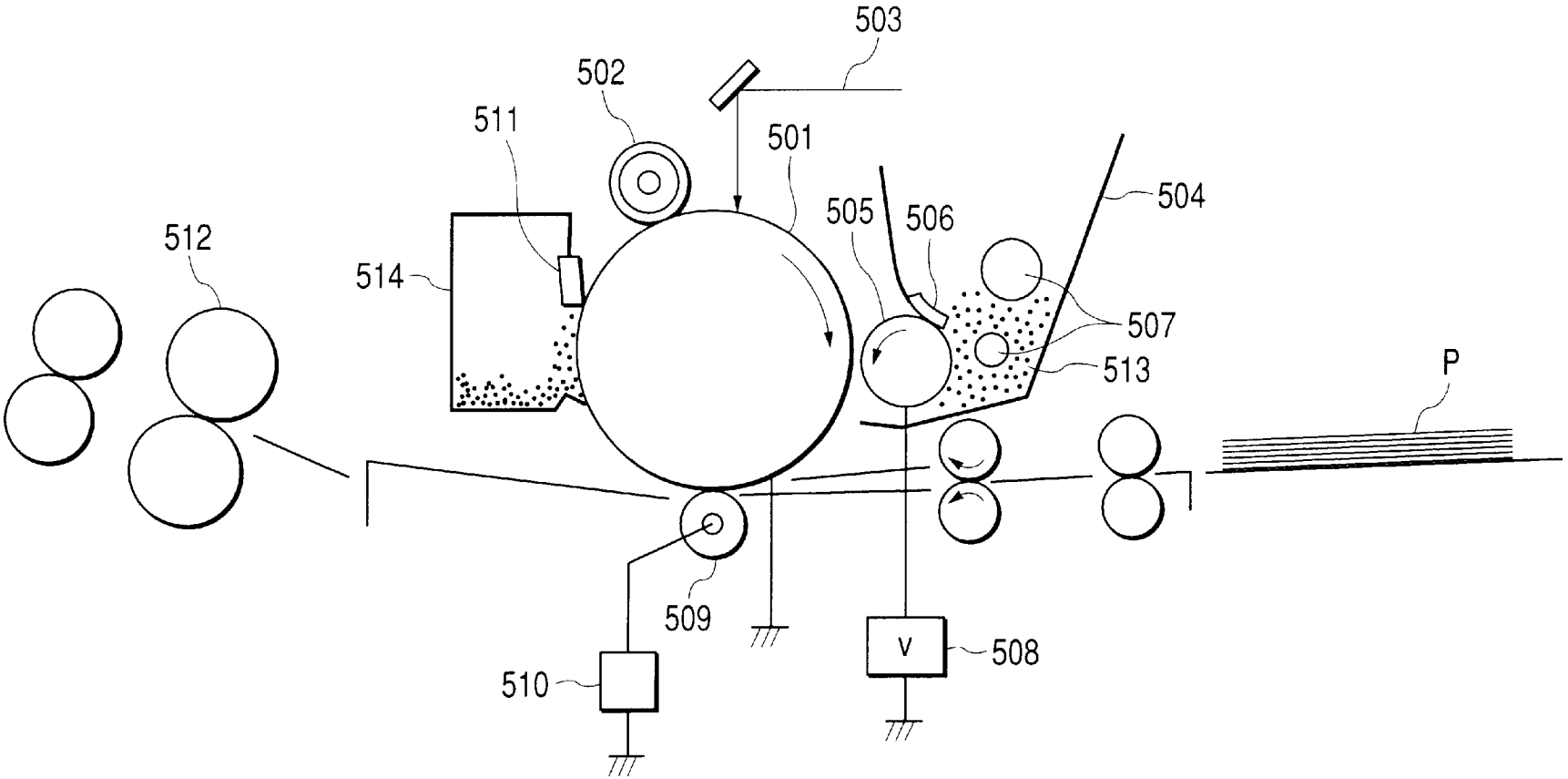
FIG. 2 is a schematic view of an example of an electrophotographic apparatus used in the fixing method of the present invention.

An example of an image-forming apparatus (electrophotographic apparatus) is schematically shown in FIG. 2, with reference to which an image-forming and fixing method is described below.

Reference numeral 501 denotes a drum-type electrostatic-latent-image-bearing member, around which a primary charging means having a charging roller (charging member) 502, an exposure optical system 503, a developing means having a toner-carrying member 505, a transfer means (transfer roller) 509 and a cleaning means (cleaning blade) 511 are disposed.

In this image-forming apparatus, the surface of the electrostatic-latent-image-bearing member 501, a photosensitive member, is uniformly electrostatically charged by means of the charging roller 502, and is thereafter exposed by means of the exposure optical system 503 to form an electrostatic latent image on the surface of the electrostatic-latent-image-bearing member 501.

As the charging member, there are no particular limitations on its shape as long as it is a contact charging member disposed in contact with the electrostatic-latent-image-bearing member. It may have the shape of a roller, a blade or a brush.

As voltages applied to the charging member, DC voltage may preferably be from 200 to 2,000 V as absolute value, and AC voltage may preferably have a peak-to-peak voltage of from 400 to 4,000 and a frequency of from 200 to 3,000 Hz.

Then, on the surface of the toner-carrying member 505 provided internally with a magnet, a toner coat layer is formed by the aid of a toner layer thickness regulation member 506, and the electrostatic latent image formed on the electrostatic-latent-image-bearing member 501 is developed applying alternating bias, pulse bias and/or DC bias by means of a means 508 for applying bias across a conductive substrate of the electrostatic-latent-image-bearing member 501 and the toner-carrying member 505. In FIG. 2, reference numerals 507 denotes an agitation means; and 513, a magnetic toner.

A toner image formed by development is electrostatically transferred to a transfer sheet P by means of the transfer roller 509, by which the transfer medium transfer sheet P is transported and which serves as a transfer means, and a voltage applying means 510; the toner image being transferred under application of charge with a polarity opposite to that of the toner from the back of the transfer sheet P.

The transfer sheet P to which the toner image has been transferred is passed through a heat-and-pressure roller fixing assembly 512, so that the toner image becomes a fixed image.

Any toner remaining on the latent-image-bearing member after the step of transfer is removed by the cleaning blade 511 as a cleaning means and is collected in a cleaner 514. Then the steps starting from primary charging are repeated.

The present invention is described below in greater detail by giving Examples. The present invention is by no means limited by the following Examples. In the following, "parts (s)" means "parts by weight".

EXAMPLE 1

First, the toner was prepared as described below. Binder resin (mixture of 70 parts of styrene-butyl acrylate copolymer having weight-average molecular weight of 12,000 with 30 parts of styrene-butyl acrylate copolymer having weight-average molecular weight of 600,000; main-peak molecular weight: 15,000; sub-peak molecular weight: 750,000; ratio of weight-average molecular weight to number-average molecular weight, Mw/Mn: 33; component in the region of molecular weight of 1,000 to 10,000: 35%) 100 parts Magnetic material ($Fe_3O_4$) 100 parts Charge control agent (monoazo iron complex) 2 parts Wax W1 (polypropylene wax; melting point: 139° C.) 5 parts A mixture of the above materials was melt-kneaded by means of a twin-screw extruder heated to 130° C., followed by cooling to obtain a cooled kneaded product, which was then crushed using a hammer mill.

According to the toner production flow shown in FIGS. 3 and 4, the crushed product thus obtained was finely pulverized using Turbo Mill Model T-250 (trade name; manufactured by Turbo Kogyo K.K.) and the pulverized product obtained was classified by means of Elbow Jet Classifier (trade name; manufactured by Nittetsu Kogyo K.K.) to obtain a median powder.

To 100 parts of the median powder thus obtained, 1.2 parts of hydrophobic fine silica powder (BET specific surface area: 110 $m^2/g$; average particle diameter: 25 nm) having been treated with silicone oil and 0.4 part of fine strontium titanate powder (BET specific surface area: 2 $m^2/g$; average particle diameter: 1.5 $\mu m$) were added, followed by mixing using a Henschel mixer to obtain a magnetic toner. Physical properties of the toner are shown in Tables 1 and 2.

As the image-forming apparatus shown in FIG. 2, a laser beam printer LJ-6L, manufactured by Hewlett Packard Co., was remodeled to have a process speed and a fixing speed of 60 mm/sec. each. The part constituting its fixing assembly was also remodeled to have the construction as shown in FIG. 1 (pressure roller: having a mandrel of 13 mm in outer diameter and a heat-resistant elastic layer formed of a silicone rubber foam in a thickness of 3 mm; single-layer construction; heat-resistant elastic layer thermal conductivity: 0.1 W/m·k) to set up a fixing assembly Ti. The above toner was set in a process cartridge of this remodeled machine of LJ-6L, and images were reproduced to make evaluation according to the following image evaluation methods. Results obtained are shown in Table 1.

The remodeled machine of LJ-6L is an image-forming apparatus in which a contact charging roller coming into contact with the surface of an OPC (organic photoconductor) photosensitive member is used as the primary charging member and which is so constructed that a charging voltage composed of a DC voltage of −625 V and AC voltage having a peak-to-peak voltage of 1.8 kV and a frequency of 370 Hz is applied to the charging roller to charge the OPC photosensitive member primarily.

Image evaluation was made in the following way.

(1) Fixing Performance

A load of $4.9\times10^{-3}$ MPa was applied to images which were printed and fixed on the first sheet after the main-body power source was put on in the state the fixing assembly became well cold in a low-temperature low-humidity environment (7.5° C./10%RH), and the fixed images were rubbed with soft thin paper. The fixing performance was evaluated by the worst value of a rate (%) of decrease in image density after the rubbing. Plover Bond (basis weight: 90 g/m$^2$) was used as test paper.

A (excellent): Less than 5%.

B (good): From 5% to less than 10%.

C (passable): From 10% to less than 20%.

D (poor): 20% or more.

(2) Anti-offset Properties

Images were continuously printed on 30 envelopes, where a sample image which was solid-black on the upper-half area was formed in A4-size paper lengthwise feed. The anti-offset properties were evaluated by the extent of any stain on the solid white area in which no image was printed. Paper having a basis weight of 64 g/m$^2$ was used as test paper.

A (excellent): No stain is seen.

B (good): Stains are little seen.

C (passable): stains are a little seen (no problem in practical use).

D (poor): Stains are seen.

(3) Pressure Roller Contamination

Using Boise Cascade X-9000 as test paper, images were printed on 1,000, 2,000 or 3,000 sheets in a low-temperature low-humidity environment (15° C./10%RH). The anti-offset properties was evaluated by visually observing the extent of contamination by toner in the interior of the fixing assembly and on the images at the time the printing was completed.

A (excellent): No contamination is seen on the pressure roller, and no contamination is also seen on the images.

B (good): Contamination is little seen on the pressure roller, and no contamination is seen on the images.

C (passable): Contamination is seen on the pressure roller, but no contamination is seen on the images.

D (poor): Contamination is seen on the pressure roller, and contamination is also seen on the images.

EXAMPLE 2

Using a toner obtained in the same manner as in Example 1 except that 5 parts of Fisher-Tropsh wax, W2, (melting point: 105° C.) was used as the wax, and image evaluation was made using the same evaluation machine as that in Example 1. Results obtained are shown in Tables 1 and 2.

EXAMPLE 3

Using a toner obtained in the same manner as in Example 1 except that 2 parts of paraffin wax, W3, (melting point: 78° C.) and 3 parts of the wax W1 were used as the wax, and image evaluation was made in the same way. Results obtained are shown in Tables 1 and 2.

COMPARATIVE EXAMPLE 1

As the toner, a toner was used which was produced in the same manner as in Example 1 except that polyalcohol wax, W4, (melting point: 980° C.) was used as the wax and an air jet pulverizer (Model I-5, manufactured by Japan Pneumatic Co.) was used in the pulverization step. With regard to the pressure roller, a fixing assembly T2 making use of the following was set up.

Mandrel outer diameter: 13 mm.

Heat-resistant elastic layer: Silicone rubber, 3 mm in thickness.

Release layer: Fluorine rubber, 50 $\mu$m in thickness; double layer structure.

Thermal conductivity of heat-resistant elastic layer+release layer: 0.3 W/m·k.

Using the above toner and fixing assembly T2, evaluation was made in the same manner as in Example 1. Results obtained are shown in Tables 1 and 2.

COMPARATIVE EXAMPLE 2

A toner was produced in the same manner as in Example 1 except that a binder resin comprised of styrene-butyl acrylate copolymer having a main-peak molecular weight of 28,700, a sub-peak molecular weight of 835,000, an Mw/Mn of 14 and the component in the region of molecular weight of 1,000 to 10,000 in an mount of 18%) was used as the binder resin and an air jet pulverizer (Model I-5, manufactured by Japan Pneumatic Co.) was used in the pulverization step. Evaluation was made using the fixing assembly used in Comparative Example 1. Results obtained are shown in Tables 1 and 2.

TABLE 1

| | | Toner | | | | | | Image evaluation | | |
|---|---|---|---|---|---|---|---|---|---|---|
| | | | DSC | GPC distribution | | | | | | |
| | Fixing assembly | Wax | endothermic peak temp. | P1 | P2 | Mw/Mn | 1,000 to 10,000 (wt. %) | Fixing performance | Anti-offset properties | Pressure roller contamination |
| Example 1 | T1 | W1 | 143° C. | 14,500 | 285,000 | 15.5 | 35 | B | B | B |
| Example 2 | T1 | W2 | 107° C. | 14,500 | 285,000 | 15.5 | 35 | A | B | B |
| Example 3 | T1 | W3 + W1 | 78° C. & 143° C. | 14,500 | 285,000 | 15.5 | 35 | A | A | A |
| Comparative Example 1 | T2 | W4 | 100° C. | 14,500 | 285,000 | 15.5 | 35 | B | C | C |
| Comparative Example 2 | T2 | W1 | 143° C. | 27,000 | 350,000 | 14 | 18 | C | B | C |

TABLE 2

| | Circularity of toner | | | |
|---|---|---|---|---|
| | 0.900 or higher (%) | 0.950 or higher (%) | 0.995 or higher (%) | 0.995/0.950 (%) |
| Example 1 | 94.5 | 78 | 11.5 | 14.5 |
| Example 2 | 95 | 79.3 | 12.3 | 15.2 |
| Example 3 | 95.5 | 80.5 | 12.5 | 15.4 |
| Comparative Example 1 | 89 | 65 | 9 | 15.3 |
| Comparative Example 2 | 88.5 | 63.9 | 7.8 | 12.4 |

What is claimed is:

1. A fixing method comprising fixing a toner image to a transfer medium under application of heat and pressure by transporting a transfer medium having a toner image formed of a toner, so as to be held between a heating member and a pressure member; the former having a rotatingly movable heat-resistant film, wherein;

said pressure member comprises a mandrel and provided thereon with a heat-resistant elastic layer having a thermal conductivity of 0.20 W/m·K or below; and said toner comprises toner particles containing at least a binder resin, a colorant and a wax, and an external additive; said toner having, in its differential scanning calorimetry endothermic curve, at least a maximum value in the region of temperature of from 105° C to 150° C., and having, in gel permeation chromatography of tetrahydrofuran-soluble component of the toner, a main peak in the region of molecular weight of from 2,000 to 25,000, a sub-peak or shoulder in the region of molecular weight of 70,000 or higher, and an Mw/Mn ratio of 8 or higher, containing 20% to 70% of a component belonging to the region of molecular weight of from 1,000 to 10,000.

2. The fixing method according to claim 1, wherein said toner further has, in its differential scanning calorimetry endothermic curve, a maximum value in the region of temperature of from 60° C. to 100° C.

3. The fixing method according to claim 1, wherein said external additive comprises a hydrophobic silica containing at least a silicone oil.

4. The fixing method according to claim 1, wherein said toner has particles with a circularity a of 0.900 or higher as determined from the following equation (A), in a proportion of 90% or larger as number-based cumulative value, and in which;

particles with a circularity a of 0.950 or higher are present in a proportion of 67% or larger as number-based cumulative value;

particles with a circularity a of 0.995 or higher are present in a proportion of 8% or larger as number-based cumulative value; and the particles with a circularity a of 0.995 or higher are present in a proportion which occupies at least 12% of the number-based cumulative value of the particles with a circularity a of 0.950 or higher.

$$\text{Circularity } a = L_0/L \quad \text{(A)}$$

wherein $L_0$ represents the circumferential length of a circle having the same projected area as a particle image, and L represents the circumferential length of the particle image.

5. The fixing method according to claim 1, wherein said toner is a toner produced through a melt-kneading step, a pulverization step and a classification step, and is a toner formed from a median powder obtained by;

melt-kneading a mixture containing at least the binder resin and the colorant, cooling the kneaded product obtained, and thereafter crushing the cooled product by a crushing means;

introducing the crushed product obtained as a powder material, into a first constant-rate feeder;

introducing the powder material in a stated quantity into a mechanical grinding machine from the first constant-rate feeder via a powder material inlet of the mechanical grinding machine; the mechanical grinding machine having at least a rotor which is a rotator attached to the center rotating shaft and a stator which is provided around the rotor, keeping a certain space between it and the rotor surface, and being so constructed that a circular space formed by keeping the space stands airtight;

rotating the rotor of the mechanical grinding machine at a high speed to finely pulverize the powder material;

discharging the finely pulverized product from a powder material discharge opening of the mechanical grinding machine and introducing the finely pulverized product into a second constant-rate feeder;

introducing the finely pulverized powder material in a stated quantity into a multi-division gas current classifier which classifies the powder material by utilizing the crossed gas streams and Coanda effect;

classifying the finely pulverized powder in the multi-division gas current classifier into at least fine powder, median powder and coarse powder to obtain the median powder; and further mixing the classified coarse powder with the powder material and introducing them into the mechanical grinding machine to carry out pulverization and classification to obtain the median powder.

6. The fixing method according to claim 5, wherein said multi-division gas current classifier is a multi-division gas current classifier having a material feed nozzle, a powder material introduction nozzle and a high-pressure air feed nozzle which are provided at the upper part of the multi-division gas current classifier, and a classifying edge block having a classifying edge provided in the multi-division gas current classifier is positionally changeable so that the shape of a classification zone can be changed.

7. The fixing method according to claim 1, wherein said heating member has a power consumption of from 0.40 Wh/sheet to 0.70 Wh/sheet, and the toner image is fixed at a fixing speed of 55 mm/second or higher.

8. The fixing method according to claim 7, wherein said toner further has, in its differential scanning calorimetry endothermic curve, a maximum value in the region of temperature of from 60° C. to 100° C.

9. The fixing method according to claim 7, wherein said external additive comprises a hydrophobic silica containing at least a silicone oil.

10. The fixing method according to claim 7, wherein said toner has particles with a circularity a of 0.900 or higher as determined from the following equation (A), in a proportion of 90% or larger as number-based cumulative value, and in which;

particles with a circularity a of 0.950 or higher are present in a proportion of 67% or larger as number-based cumulative value;

particles with a circularity a of 0.995 or higher are present in a proportion of 8% or larger as number-based cumulative value; and the particles with a circularity a of 0.995 or higher are present in a proportion which occupies at least 12% of the number-based cumulative value of the particles with a circularity a of 0.950 or higher.

$$\text{Circularity } a = L_0/L \quad \text{(A)}$$

wherein $L_0$ represents the circumferential length of a circle having the same projected area as a particle image, and L represents the circumferential length of the particle image.

11. The fixing method according to claim 7, wherein said toner is a toner produced through a melt-kneading step, a pulverization step and a classification step, and is a toner formed from a median powder obtained by;

melt-kneading a mixture containing at least the binder resin and the colorant, cooling the kneaded product obtained, and thereafter crushing the cooled product by a crushing means;

introducing the crushed product obtained as a powder material, into a first constant-rate feeder;

introducing the powder material in a stated quantity into a mechanical grinding machine from the first constant-rate feeder via a powder material inlet of the mechanical grinding machine; the mechanical grinding machine having at least a rotor which is a rotator attached to the center rotating shaft and a stator which is provided around the rotor, keeping a certain space between it and the rotor surface, and being so constructed that a circular space formed by keeping the space stands airtight;

rotating the rotor of the mechanical grinding machine at a high speed to finely pulverize the powder material;

discharging the finely pulverized product from a powder material discharge opening of the mechanical grinding machine and introducing the finely pulverized product into a second constant-rate feeder;

introducing the finely pulverized powder material in a stated quantity into a multi-division gas current classifier which classifies the powder material by utilizing the crossed gas streams and Coanda effect;

classifying the finely pulverized powder in the multi-division gas current classifier into at least fine powder, median powder and coarse powder to obtain the median powder; and further mixing the classified coarse powder with the powder material and introducing them into the mechanical grinding machine to carry out pulverization and classification to obtain the median powder.

12. The fixing method according to claim 11, wherein said multi-division gas current classifier is a multi-division gas current classifier having a material feed nozzle, a powder material introduction nozzle and a high-pressure air feed nozzle which are provided at the upper part of the multi-division gas current classifier, and a classifying edge block having a classifying edge provided in the multi-division gas current classifier is positionally changeable so that the shape of a classification zone can be changed.

13. The fixing method according to claim 7, wherein said pressure member comprises a pressure roller, the pressure roller has a surface temperature of from 110° C. to 160° C., and said toner contains a wax having a melting point of from 105° C. to 155° C.

14. The fixing method according to claim 13, wherein said wax is a wax having a melting point of from 110° C. to 150° C.

15. The fixing method according to claim 7, wherein said pressure member comprises a pressure roller, the pressure roller has a surface temperature of from 110° C. to 150° C., and said toner contains a wax having a melting point of from 110° C. to 150° C. and a wax having a melting point of from 60° C. to 95° C.

16. The fixing method according to claim 7, wherein said wax is contained in said toner in an amount of from 0.5 part by weight to 30 parts by weight based on 100 parts by weight of the binder resin.

17. The fixing method according to claim 7, wherein said wax is contained in said toner in an amount of from 2 parts by weight to 10 parts by weight based on 100 parts by weight of the binder resin.

18. The fixing method according to claim 7, wherein said toner has, in its differential scanning calorimetry endothermic curve, endothermic peaks in the region of temperature of from 60° C. to 90° C. and in the region of temperature of from 110° C. to 150° C.

* * * * *

UNITED STATES PATENT AND TRADEMARK OFFICE

CERTIFICATE OF CORRECTION

PATENT NO. : 6,475,686 B2
DATED : November 5, 2002
INVENTOR(S) : Osamu Tamura et al.

It is certified that error appears in the above-identified patent and that said Letters Patent is hereby corrected as shown below:

Title page,
Item [56], FOREIGN PATENT DOCUMENTS,
"42-23910 11/1942" should read -- 42-23910 11/1967 --.
"43-24748 10/1943" should read -- 43-24748 10/1968 --.

Column 5,
Line 3, "was." should read -- wax. --.
Line 19, "such as" (1st occurrence) should be deleted.

Column 11,
Line 65, "complicate" should read -- complicated --.

Column 16,
Line 7, "used" should read -- be used --.
Line 8, "toner" should read -- toner and --.

Column 22,
Line 63, "Ti." should read -- T1. --.

Column 23,
Line 41, "was" should read -- were --.

Column 24,
Line 22, "980ºC.)" should read -- 98ºC.) --.
Line 44, "18%)" should read -- 18% --.

Signed and Sealed this

Tenth Day of June, 2003

JAMES E. ROGAN
*Director of the United States Patent and Trademark Office*